US008353427B2

(12) United States Patent
Landauer

(10) Patent No.: US 8,353,427 B2
(45) Date of Patent: Jan. 15, 2013

(54) AUTOMATIC DISPENSER FOR HAND-SANITIZER LOTION

(76) Inventor: Konrad Landauer, Chicago, IL (US)

( * ) Notice: Subject to any disclaimer, the term of this patent is extended or adjusted under 35 U.S.C. 154(b) by 262 days.

(21) Appl. No.: 12/901,965

(22) Filed: Oct. 11, 2010

(65) Prior Publication Data

US 2012/0085780 A1 Apr. 12, 2012

(51) Int. Cl.

| | |
|---|---|
| ***B67D 1/00*** | (2006.01) |
| ***B67D 7/14*** | (2010.01) |
| ***B67D 1/16*** | (2006.01) |
| ***B67D 7/84*** | (2010.01) |
| ***B67D 7/74*** | (2010.01) |
| ***B67D 7/06*** | (2010.01) |
| ***B67D 7/60*** | (2010.01) |
| ***B65D 35/28*** | (2006.01) |
| ***B65D 37/00*** | (2006.01) |
| ***G01F 11/00*** | (2006.01) |

(52) U.S. Cl. ..... 222/52; 222/95; 222/108; 222/132; 222/143; 222/181.3; 222/214; 222/333; 222/386.5

(58) Field of Classification Search ..... 222/52, 222/63, 95, 105, 108, 111, 129, 132, 135, 222/143, 181.2, 181.3, 182, 192, 207, 214, 222/333, 386.5

See application file for complete search history.

(56) References Cited

U.S. PATENT DOCUMENTS

| | | | | |
|---|---|---|---|---|
| 3,037,673 | A * | 6/1962 | Tornquist | 222/181.2 |
| 3,955,715 | A * | 5/1976 | Topor | 222/143 |
| 4,265,370 | A | 5/1981 | Reilly | |
| 4,324,348 | A * | 4/1982 | Johnson et al. | 222/181.2 |
| 4,921,150 | A * | 5/1990 | Lagergren et al. | 222/639 |
| 5,199,118 | A | 4/1993 | Cole | |
| 5,277,332 | A * | 1/1994 | Rogers | 221/96 |
| 5,370,267 | A | 12/1994 | Schroeder | |
| 5,397,028 | A | 3/1995 | Jesadanont | |
| 5,625,659 | A | 4/1997 | Sears | |
| 5,638,989 | A * | 6/1997 | Ophardt et al. | 222/105 |
| 5,810,201 | A * | 9/1998 | Besse et al. | 222/39 |
| 6,209,751 | B1 | 4/2001 | Gooden et al. | |
| 6,209,752 | B1 * | 4/2001 | Mitchell et al. | 222/63 |
| 6,390,329 | B1 | 5/2002 | Maddox | |
| 6,404,837 | B1 | 6/2002 | Thompson et al. | |
| 6,707,873 | B2 | 3/2004 | Thompson et al. | |
| 7,477,148 | B2 | 1/2009 | Lynn et al. | |
| 7,611,030 | B2 | 11/2009 | Reynolds et al. | |

* cited by examiner

*Primary Examiner* — Kevin P Shaver
*Assistant Examiner* — Vishal Pancholi

(57) ABSTRACT

An automatic dispensing apparatus for dispensing hand-sanitizer lotion, which is powered using a rechargeable battery pack rechargeable via solar cells, which battery pack is pivotally mounted in the upper interior section of the main frame of the dispenser, above the liquid-storage bag, whereby as the liquid storage bag is depleted after continual use, the weight of the battery pack serves to compress the storage bag to thereby increase the pressure therein, so that the delay of the dispensing of the liquid does not increase over time as the bag becomes depleted. Also provided is a lower, pivotal tray located below the dispensing nozzle of the dispensing apparatus by which drippings and excess dispensed amounts are caught by the tray and do not fall upon the floor therebelow. A front cover is rotatable to an upper position such that it does not rotate back down by itself in order to allow unencumbered access to the interior of the apparatus for changing storage bags and batteries. The apparatus also contains an aerosol spray canister for spraying a sanitizing mist into the ambient surroundings after the apparatus has dispensed sanitizing fluid onto the hands.

20 Claims, 15 Drawing Sheets

AUTOMATIC DISPENSER FOR HAND-SANITIZER LOTION

BACKGROUND OF THE INVENTION

The present invention is directed to a dispensing device or apparatus for dispensing measured or metered amounts of a hand-sanitizer or hand-antiseptic lotion, liquid, fluids and the like, for use in sanitizer hands in hospitals, doctor offices, health clinics, and the like.

In U.S. Pat. No. 6,209,752, which reference is incorporated by reference herein, there is disclosed an automatic liquid dispenser that is powered by rechargeable batteries rechargeable by solar power cells or panels. The liquid, such as soap, is provided in a disposable cartridge containing a dispensing bag or pouch, to which cartridge is attached the rechargeable batteries. The solar cells are mounted to the frame of the dispensing device and generate electricity for recharging the batteries via ambient fluorescent lights in the room or location in which the dispenser is mounted. The dispenser is also provided with a pump assembly for dispensing metered amounts of the liquid, and electric circuitry for controlling the pump to mete out this measured amount. The device is activated automatically when a hand or hands are located at the dispensing station via a light-sensitive receiver that detects LED-reflected light as the hand or hands are located at the dispensing nozzle. The metered dispensing of the contents of the bag or pouch is, however, delayed, and as the contents of the bag is depleted over continual dispensed amounts, the delay becomes more pronounced because of the reduced pressure in the bag or pouch.

SUMMARY OF THE INVENTION

It is the primary objective of the present invention to provide an automatic dispensing apparatus that is powered using a rechargeable battery pack rechargeable via solar cells, which battery pack is pivotally mounted in the upper interior section of the main frame of the dispenser, above the liquid-storage bag, whereby, as the liquid-storage bag or refill-pouch is depleted after continual use, the weight of the battery pack serves to compress the storage bag to thereby increase the pressure therein, so that the delay of the dispensing of the liquid does not increase over time as the pouch becomes depleted.

It is also a primary objective of the present invention to provide a lower, pivotal tray located below the dispensing nozzle of the dispensing apparatus by which drippings and excess dispensed amounts are caught by the tray and do not fall upon the floor therebelow, which tray is rotatable to an upper, closed position where access to the dispensing nozzle of the apparatus is prevented.

It is also a primary objective of the present invention to provide sensors that deactivate the dispensing apparatus when either the front cover is lifted for access to the interior of the apparatus, or when the lower tray is pivoted upwardly, so as to prevent the dispensing of the fluid.

It is also a primary objective of the present invention to provide sensors that deactivate the dispensing apparatus when either the front cover is lifted for access to the interior of the apparatus e fluid onto the floor.

It is also a primary objective of the present invention to provide a canister of sanitizing fluid which is activated upon the sensing of a hand at the apparatus Orr when a person enters the room, in order to provide a spray of sanitizing mist into the ambient surroundings.

BRIEF DESCRIPTION OF THE DRAWINGS

The invention will be more readily understood with reference to the accompanying drawings, wherein.

DETAILED DESCRIPTION OF THE INVENTION

Figure 3:
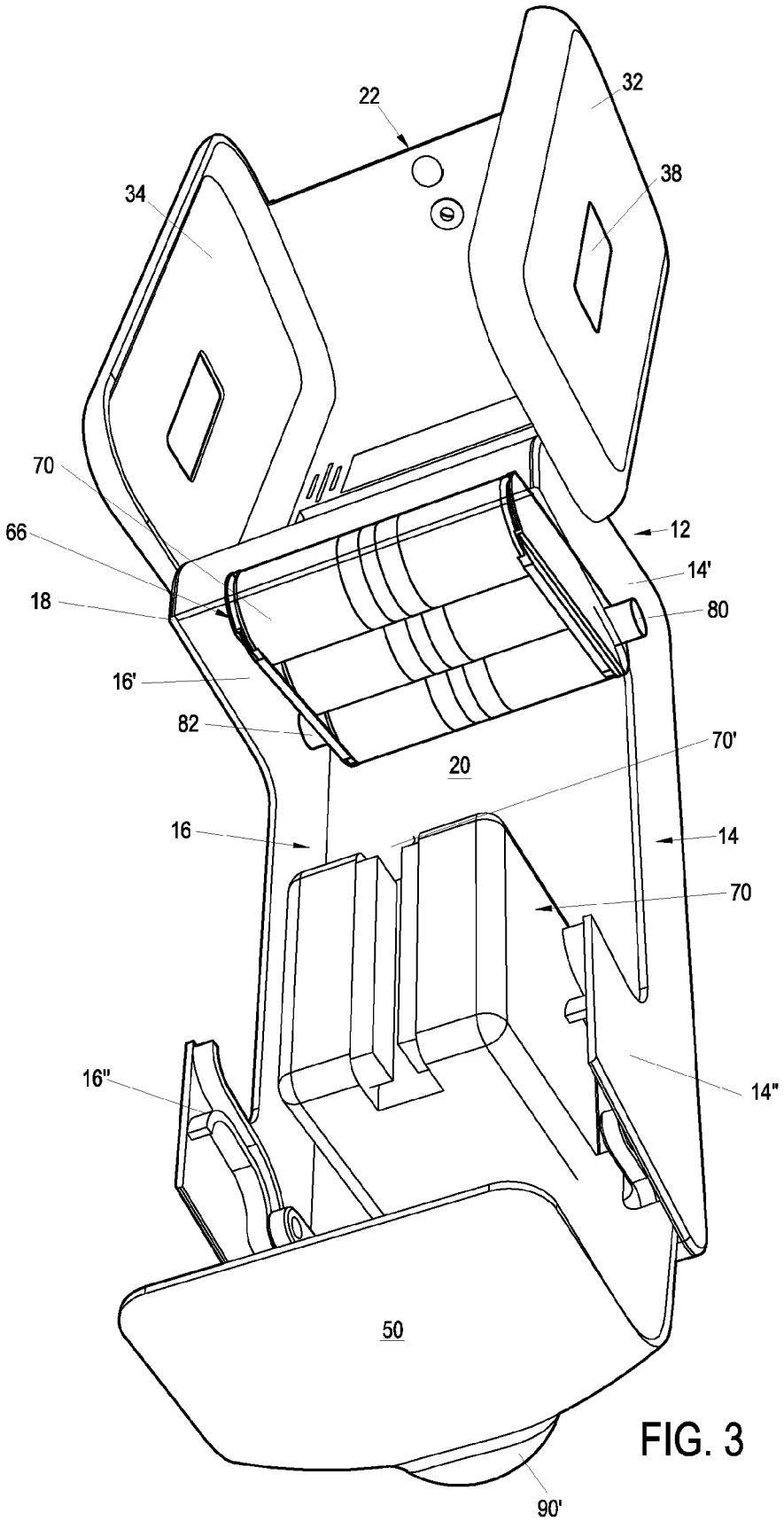
FIG. 3 is a perspective view of the automatic dispensing apparatus of the invention with the cover thereof raised for showing the interior working components.

Referring now to the drawings in greater detail, the automatic dispensing apparatus of the invention is indicated generally by reference numeral 10. The apparatus 10 consists of a main housing 12 defining a pair of side walls 14, 16, top or upper wall 18, rear wall 20 which is typically mounted to a wall or vertical surface, and a pivotally-mounted, front cover panel or door 22. The front panel 22 is provided with a first, conventional solar panel 24 by which power is generated for recharging a 6-Volt battery pack, for example, described hereinbelow. Also provided on the front cover panel is an LCD advertising display unit 24' for displaying advertising or other visual and audio material, or for giving instructions on how to use the apparatus. The side walls 14, 16 of the main frame are provided with an intermediate cutout-section by which access to the interior of the apparatus is enhanced when refilling the storage bag or refill-pouch, or for replacing the battery pack. Thus, each side wall 14,16 defines an upper wider section 14', 16', and a lower wider section 14", 16", respectively, as best seen in FIG. 3.

Figure 1:
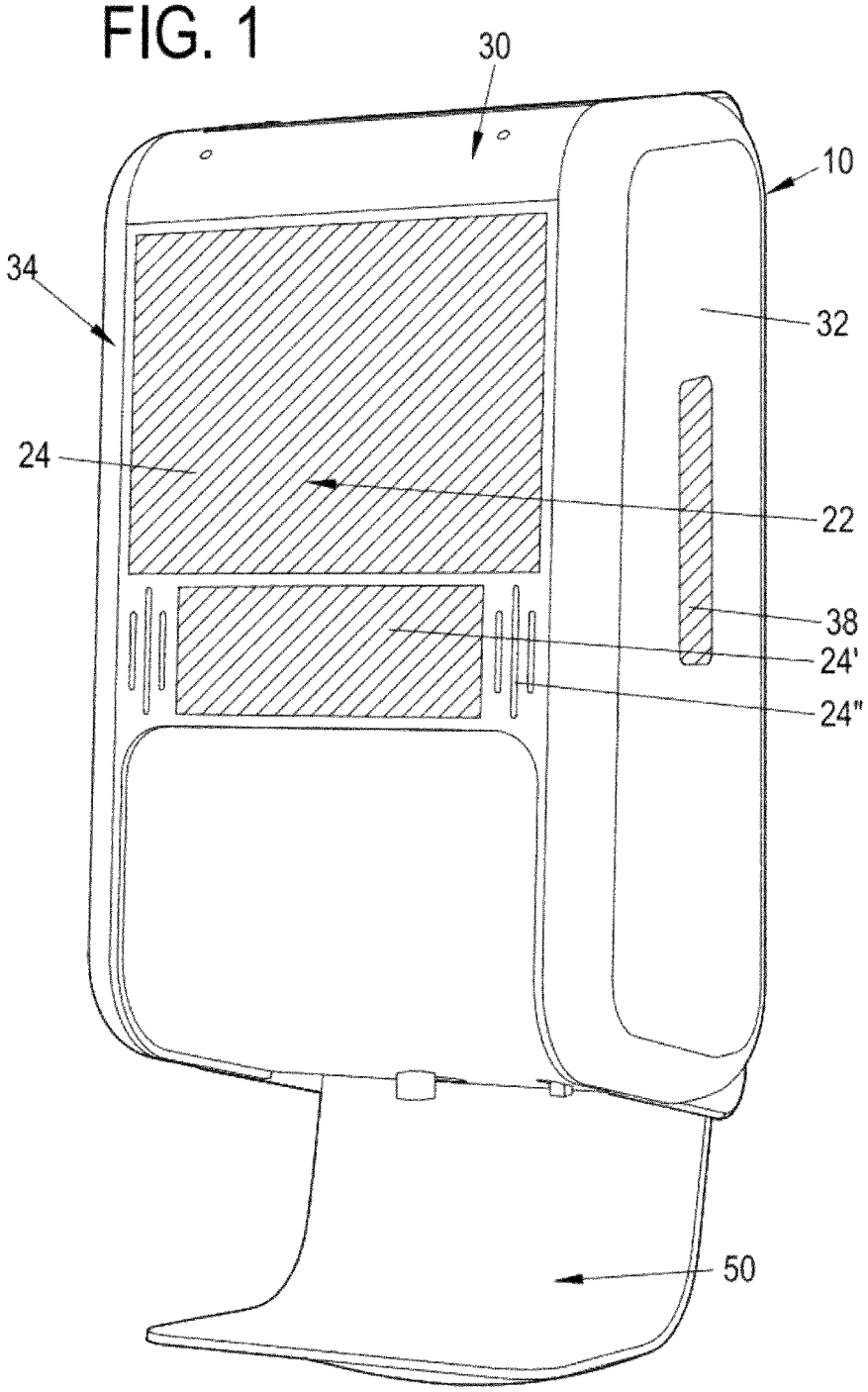
FIG. 1 is an isometric view of the automatic dispensing apparatus of the invention showing the pivotal lower tray thereof in its downward position.

The front panel 22 is pivotally mounted to the main frame via conventional pivots or posts, such that, when lifted to its upper, open position, its center of gravity is located such that it causes the front panel to pivot backwardly or rearwardly, in order that it will stay or remain in its opened position, so that it does not interfere with the refilling procedure of the refill or storage bag. The front cover panel 22 consists of a front surface 30, to which are mounted the first solar panel 24 and LCD advertising or instructional display 24' with speakers 24", and a pair of side walls 32, 34 projecting rearwardly from the side edge-surfaces of the front surface 30, as best see in FIGS. 1 and 2. The side walls 32, 34 are, also, provided with solar panels 38 for generating additional power for the battery pack, described hereinbelow. As can best seen in FIG. 7, each of the side walls 32, 34 has an inwardly-projecting pivot post 40, 42, respectively, located at the upper end when viewing the front cover panel in its closed or downwardly-pivoted position shown in FIGS. 1 and 2. These pivot posts 40, 42 are skewed or closer to the front surface 30 so that when the front cover panel 20 is pivoted to its upward, open position, its center of gravity is located such that it causes the front panel to pivot backwardly or rearwardly, in order that it will stay or remain in its opened position, so that it does not interfere with the refill procedure when the refill-bag is empty and must be refilled. A pair of holes 40', 42' are provided in the upper wider sections 14', 16' of the side walls 14, 16, respectively, of the main frame 12, which holes are also located more toward the front the apparatus in order to allow for the above-described rearward pivoting of the front cover door when in its opened position.

Figure 4:
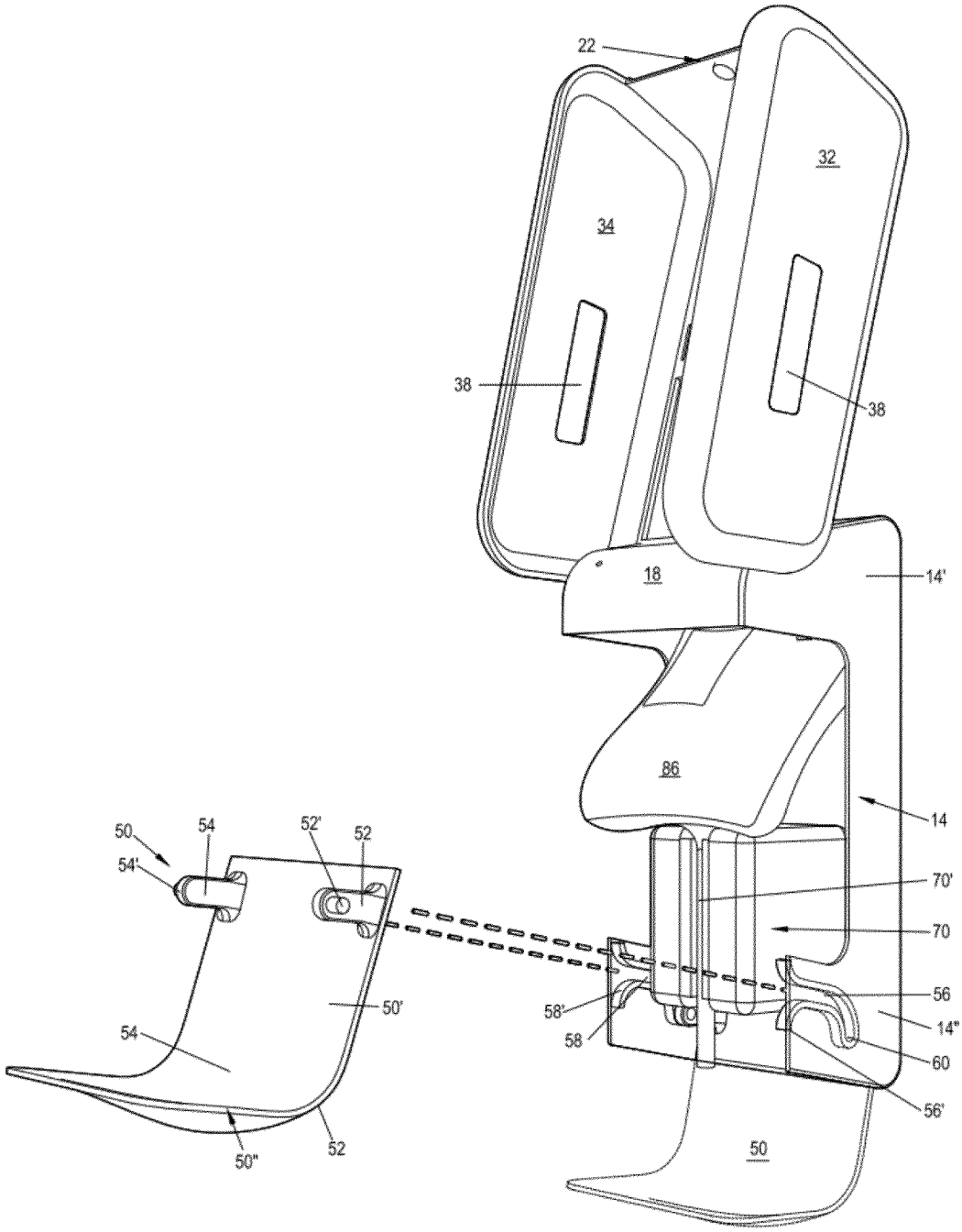
FIG. 4 is an assembly isometric view of the automatic dispensing apparatus of the invention with the cover thereof raised showing the mounting of the lower pivotal tray to the main housing of the apparatus.
Figure 6:
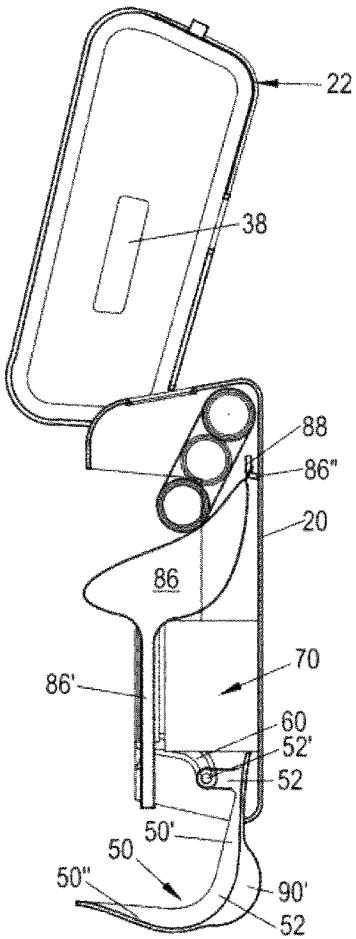
Figure 5:
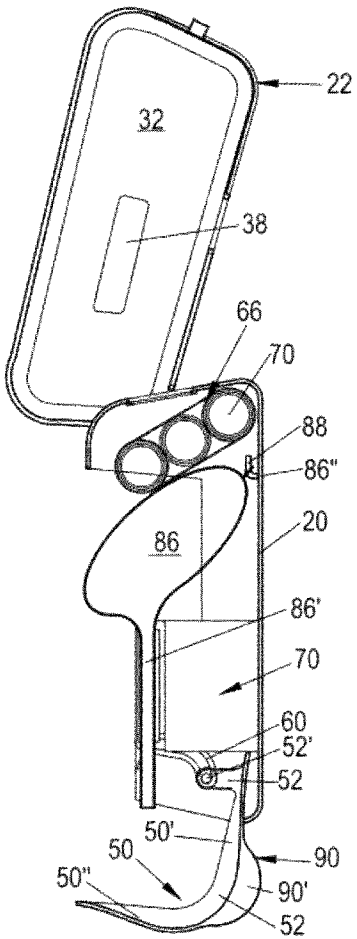
FIG. 5 is a broken-away, side elevational view of the apparatus of FIG. 1 showing the rechargeable battery pack pivoted in a first, upper position for contact against the upper portion of the storage bag for increasing the pressure within the bag; a FIG. 6 is a view similar to FIG. 5 but showing the rechargeable battery pack pivoted in a second, lower position for contact against the upper portion of the storage bag for increasing the pressure within the bag after part of the contents of the bag have been dispensed over time.
Figure 7:
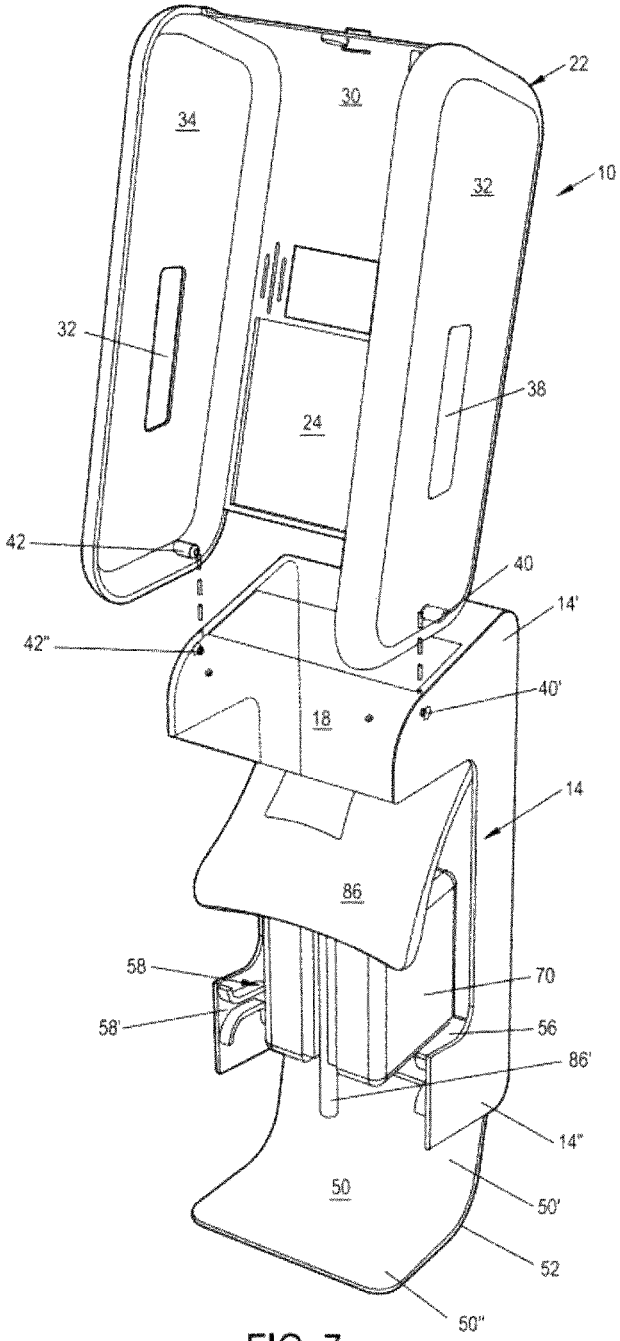
FIG. 7 is an assembly isometric view of the automatic dispensing apparatus of the invention showing the attachment of the pivotal front cover panel thereof to the main housing of the apparatus.
Figure 8:
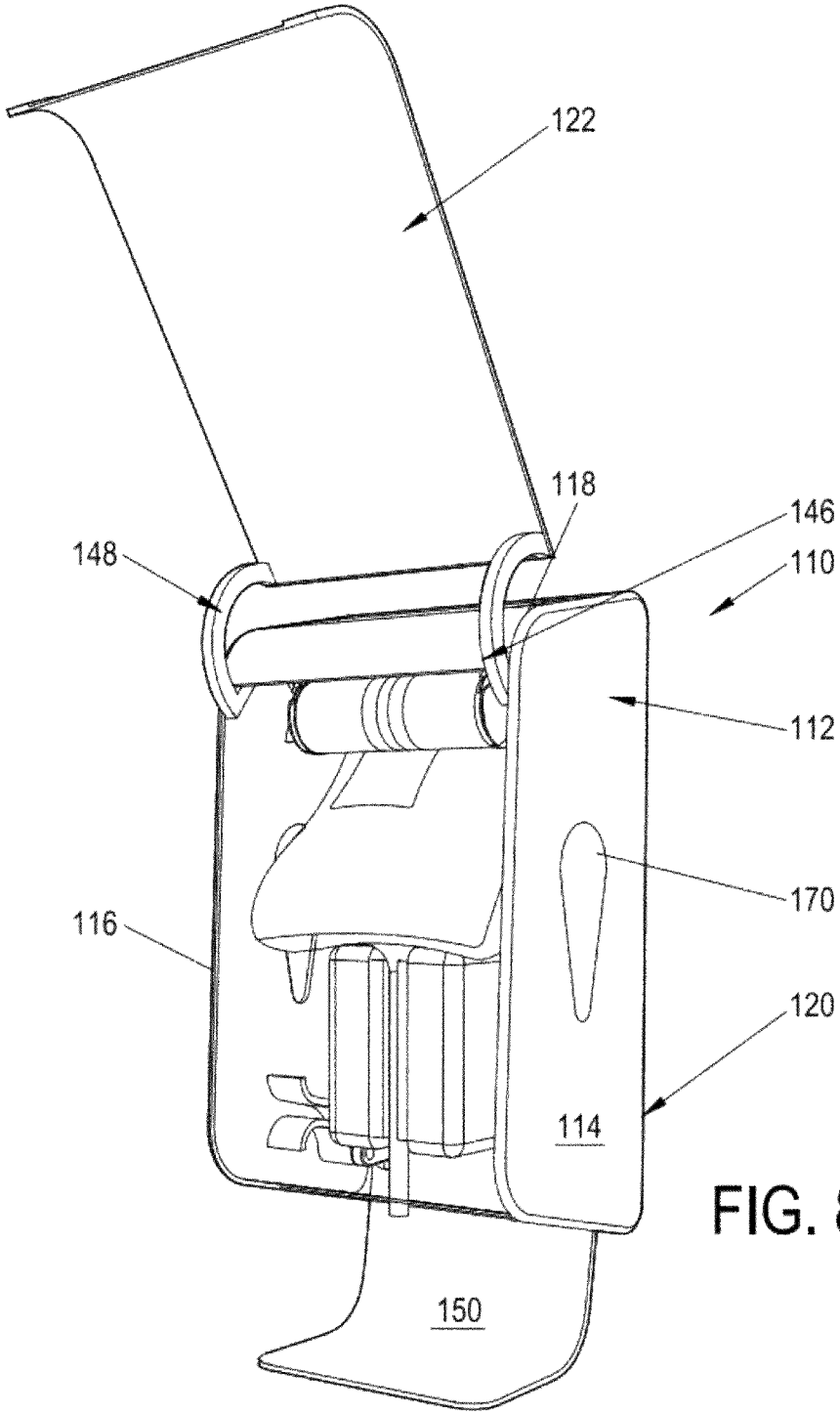
FIG. 8, is an isometric view showing the automatic dispensing apparatus of the invention according to a second embodiment thereof.

The dispensing apparatus 10 is also provided with a lower, pivotal tray 50 that is has a first upper section 50' and a second lower section 50" connected by an intermediate connecting curved surface 52. The second lower section 50" defines an upper, generally concave or depressed surface 54, whereby any dispensed liquid falling of the hands or dispensed after the hands have been removed will fall upon this upper concave surface 54 and thus be caught and prevented from falling to the floor below, where the fallen liquid is unsightly and may constitute a hazard of a foot slipping thereon. As can be seen in FIG. 4, the upper section 50' has a pair of oppositely-disposed, outwardly-projecting ears 52, 54 with each having a pivot post 52', 54', respectively projecting laterally for reception in grooves 56, 58, respectively, formed in the lower wider sections 14", 16", respectively. Each groove 56, 58 has an enlarged entrance opening 56', 58, respectively, for receiving the respective posts 52', 54'. Each groove 56, 58 defines a first straight section and an end-curved section 60 that defines a bottom trough in which the respective post rests. During assembly, the posts 52', 54' are placed into the entrance openings 56' 58', and slid rearwardly along the straight section of the grooves 56, 58 until reaching the curved section 60 whereupon the post rests in the bottom trough thereof. This downwardly-curved section 60 with its bottom trough allows the tray 50 to be maintained or kept in its pivoted, downward position, as seen in FIGS. 5 and 6. This is owing to the fact that any upper, pivotal movement of the tray is prevented by contact of the upper edge of the upper section 50' thereof against the rear wall 20 of the main frame 12, as can be seen in FIGS. 5 and 6. In order to the pivot the tray 50 to its upper, closed position shown in FIGS. 1 and 2, the oppositely-disposed, outwardly-projecting ears 52, 54 with post 52', 54' are slid upwardly in the end-curved section 60 of the grooves 56, 58 until reaching the straight sections of the grooves, whereupon the enough clearance is provided between the upper edge of the upper section 50' and the rear wall 20 of the main frame 12, as can be seen in FIGS. 7 and 8. The tray 50 is maintained in its upper closed position by any conventional means, such as by magnets, and the like, whereby access to the dispensing nozzle is prevented, such as when the refill pouch has to be refilled or when the batteries have to replaced. This upper, pivotal position of the tray also provides advantages in packaging and shipping of dispensers.

Figure 2:
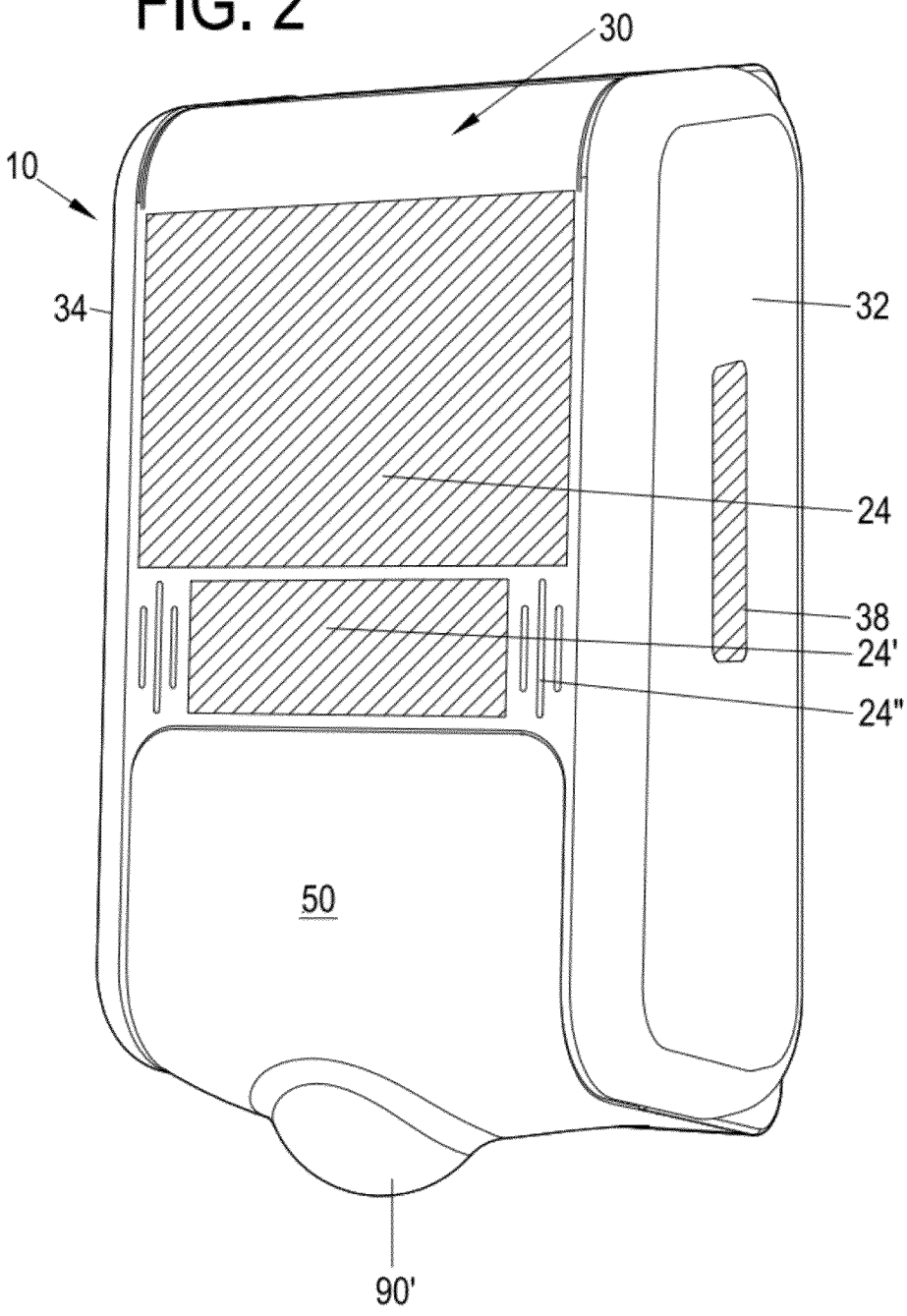
FIG. 2 is an isometric view of the automatic dispensing apparatus of the invention showing the pivotal tray in its upper, closed position.

The rear surface of the upper section 50' as well as the intermediate connecting curved surface 52 of the lower tray 50, define a projecting or protruding knob or protuberance 90, as best seen in FIGS. 2, 5 and 6. The knob 90 defines a rearward-most surface 90' that abuts against the wall surface to which the apparatus 10 is mounted. The overall depth of knob from its integral connection with the rear surface of the upper section 50' and the intermediate connecting curved surface 52 is such that when the rearward-most surface 90' abuts against wall, the overall tray assumes a pivoted position, said tray further comprising a rearwardly-extending protuberance for contact against a wall to which is mounted said rear wall of said main housing for orienting said tray in a pivoted state such that said the forward edge surface of horizontal section 50" is positioned or located forwardly of the dispensing nozzle so that the tray captures excess fluid dispensed through said nozzle.

As mentioned above, the automatic dispensing apparatus 10 is provided with a rechargeable battery pack 66 best seen in FIGS. 3, 5 and 6. The battery pack consists of rechargeable batteries that receive recharging current via the solar panels 24 and 38. The electric circuitry for converting the solar energy of the solar panels to electric current is conventional, and may be that disclosed in above-mentioned U.S. Pat. No. 6,209,752. The battery pack also has its own, backup, conventional recharging device for recharging the batteries if for some reason the solar power fails or if the solar power is not able to provide the necessary power, as, for example, during heavy usage of the apparatus over a short period of time. The battery pack 66 is used to power a conventional pump unit that is housed in a housing 70 located in the lower interior section of the main housing 12, which pumps out fluid from the refill-pouch 86 via its integral tubing 86' having a lower, nozzle-dispensing end 86", in the manner disclosed in above-mentioned U.S. Pat. No. 6,209,752, which patent is incorporated by reference herein. A groove 70' is provided in which the conventional tubing 86' is secured.

The battery pack 66 consists of a housing 72 defining a pair of side plates or walls 74,76 from the rear of which project a pair of pivot pins 80, 82 which are received in the corresponding holes formed in the upper wider sections 14', 16' of the side walls 14, 16, whereby the battery housing 72 is pivotal. The battery housing also defines a bottom surface 72', a portion of which rests or is seated upon the upper portion of a replaceable storage bag or refill-pouch 86, as best seen in FIGS. 5 and 6. By having the battery pack rest upon the top of the refill-pouch 86, the refill-pouch is itself compressed, as seen in FIG. 6, where the original pressure in the bag is substantially maintained, to thus ensure constant-speed dispensing of the fluid contents of the bag regardless of the fill-state of the refill-pouch. This is especially important as the contents of the bag become depleted over many dispensed amounts, when the fluid pressure from the fluid contents itself would become diminished if not for the pressure provided via the battery pack. The refill-pouch 86 is provided with an upper ring 86" (FIGS. 5 and 6) for mounting it to a hook 88 projecting from the front surface of the rear wall 20.

By way of example, the dispensing apparatus 10 may typically have an overall length from the top wall to the bottom of the lower pivotal tray of about 1 foot, 5-/8 inch, an overall width of about six inches, and a depth of about 4⅝ inches. The lower pivotal tray is about, for example, 4⅞ inches in width. These dimensions are only given by way of example and are not to be construed as limiting in any manner.

Figure 9:
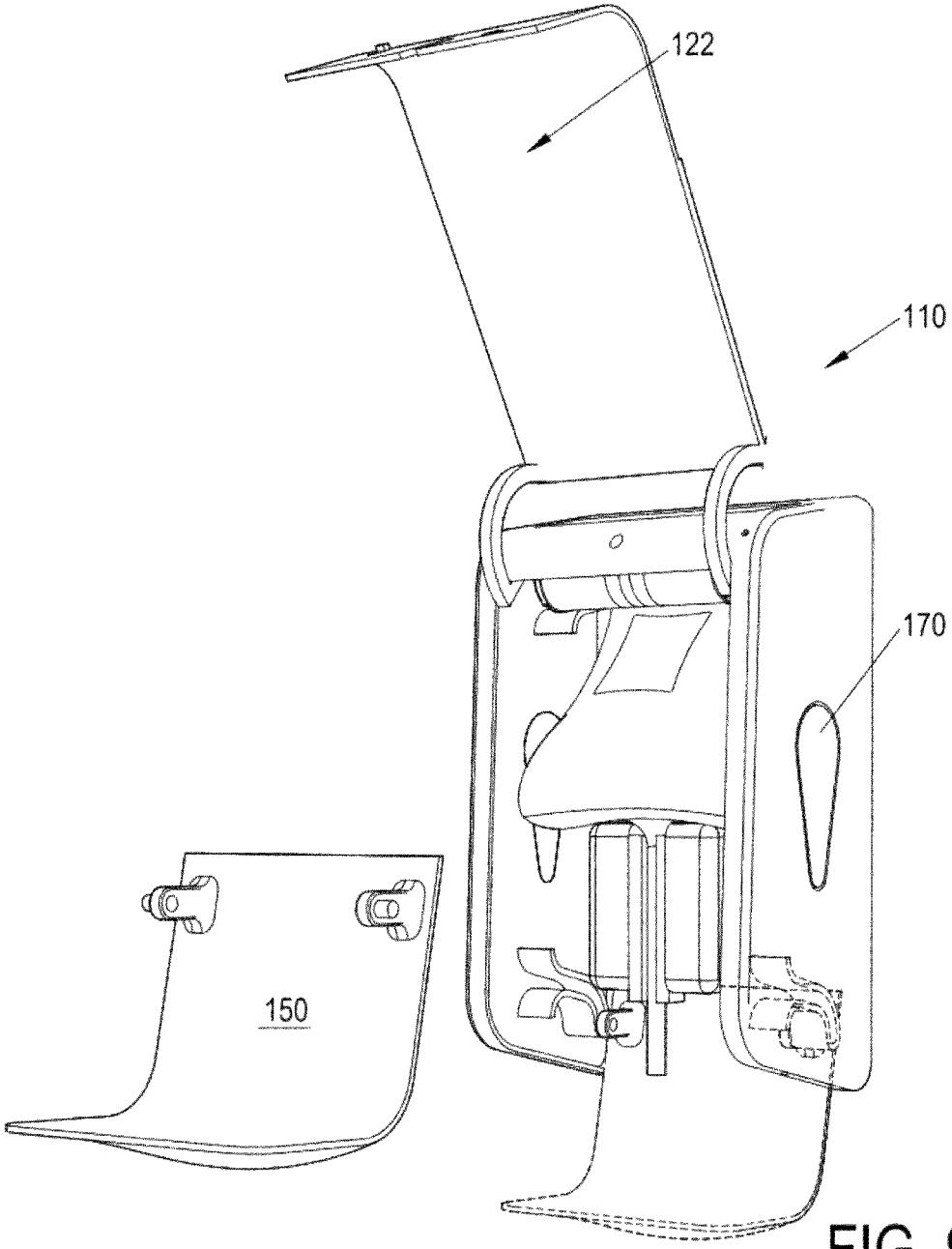
FIG. 9 is an assembly isometric view similar to FIG. 4 thereof.
Figure 10:
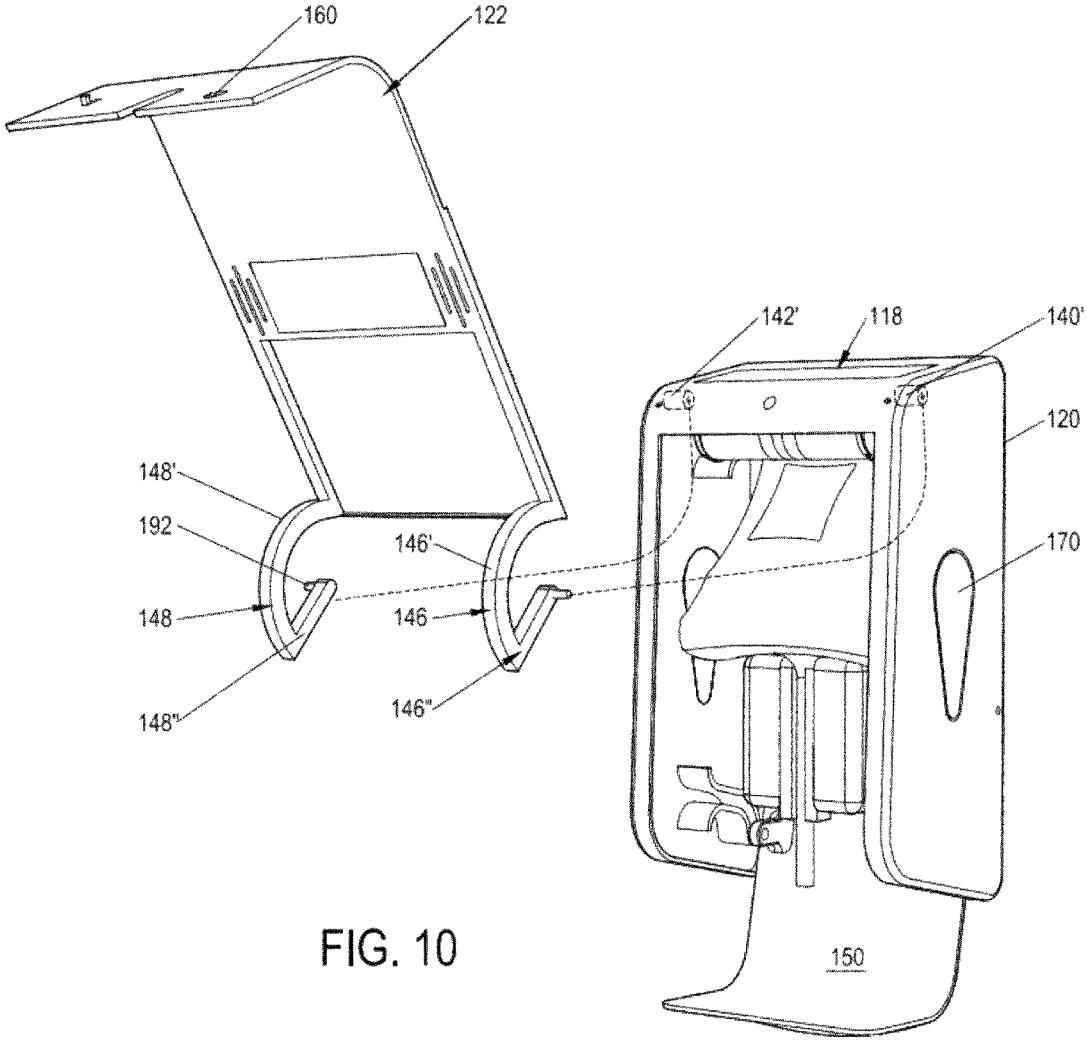
FIG. 10 is an assembly isometric view similar to FIG. 7 thereof.
Figure 11:
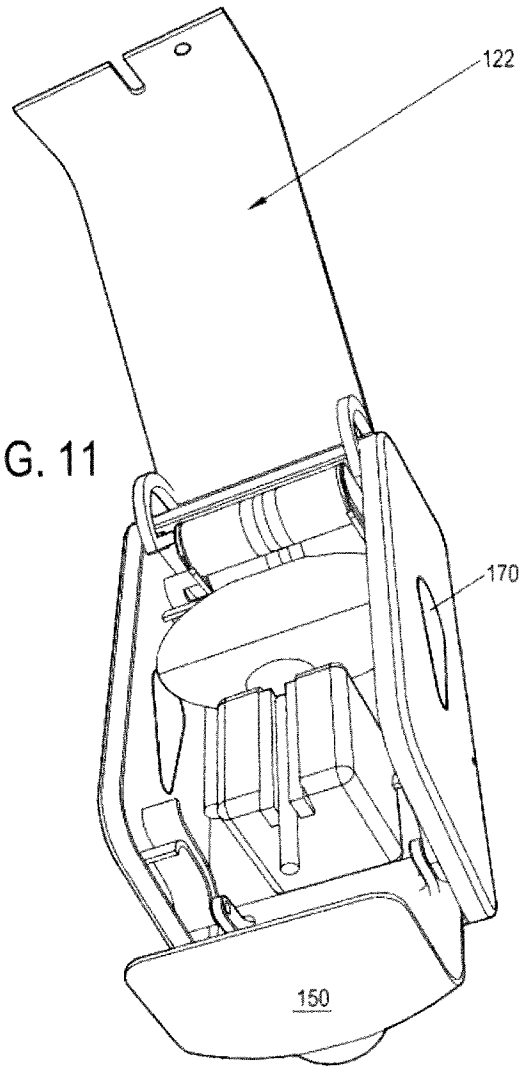
FIG. 11 is a perspective view of the automatic dispensing apparatus of the invention of FIG. 8 with the cover thereof raised for showing the interior working components.
Figure 12:
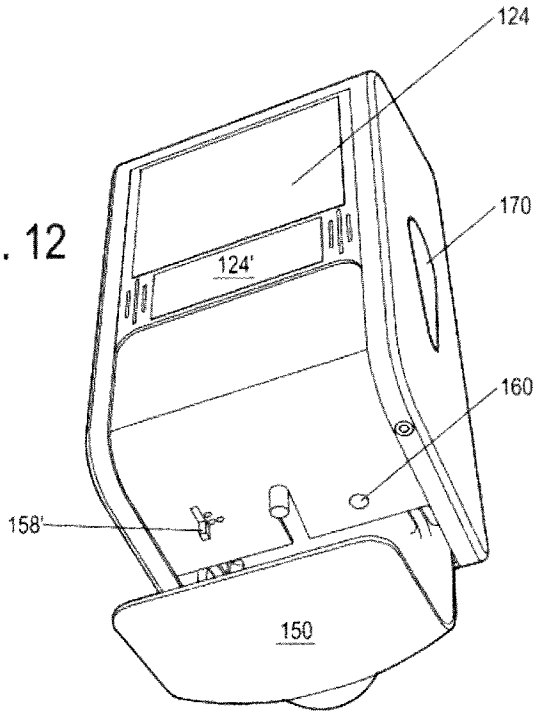
FIG. 12 is a perspective view of the apparatus of FIG. 8 with the front cover in is closed state.

Referring now to FIGS. 8-15, there is shown a second embodiment of the automatic dispensing apparatus of the invention and is indicated generally by reference numeral 110. The apparatus 110 consists of a main housing 112 defining a pair of side walls 114, 116, top or upper wall 118, rear wall 120 which is typically mounted to a wall or vertical surface, and a pivotally-mounted, front cover panel or door 122. The front panel 122 is provided with a first, conventional solar panel 124 by which power is generated for recharging a 6-Volt battery pack, for example, as described above. Also provided on the front cover panel is an LCD advertising display unit 124' for displaying advertising or other visual and audio material, or for giving instructions on how to use the apparatus. The side walls 114, 116 of the main frame in this embodiment are not provided with an intermediate cutout-section as in the first embodiment, but rather each of the side walls 114, 116 are complete, as can be seen in FIGS. 8-10.

The front panel 122 is pivotally mounted to the main frame via conventional pivots or posts 140, 142, that are received in holes 140', 142' in the upper portion of the housing as seen in FIG. 10. Each of the pivot posts 140, 142 is connected to a mounting bracket 146, 148, respectively, each defining an arcuate main section 146', 148', respectively, from which extends a linear section 146", 148" at the end of which is provided the respective pivot post. The mounting brackets 146, 148 ensure that the front panel 122 remains in its open position when refilling the refill or storage bag or when replacing the battery pack, and such that is positioned well above the top wall 118 so as to allow ready and easy access to the interior of the housing 112.

The front cover panel 122 consists of a front surface 130, to which are mounted the first solar panel 124 and LCD advertising or instructional display 124' with speakers 124", but has no side walls, so as to ensure ease of access to the interior of the housing. The dispensing apparatus 110 is also provided with a lower, pivotal tray 150 that is substantially similar to the lower tray 50 of the first embodiment.

The apparatus 110 is also provided with separate sensors at the front of the device. A first one 158 is a conventional one that detects the positioning of a hand or hands at the dispensing station in order to activate the device. A second sensor 160 activates that the display 124' upon the positioning of a hand or hands thereat.

It is also noted that the apparatus is also provided with a shut-off sensor for disabling the pump for dispensing the liquid from the refill-pouch whenever the front panel or the lower tray is pivoted upwardly. The sensor controls a conventional shut-off device for disabling the pump assembly when the sensor is activated. This ensures that whenever access to the interior of the apparatus occurs, no accidental dispensing of liquid from the refill-pouch occurs, so as not to sully the floor therebelow.

Figure 13:
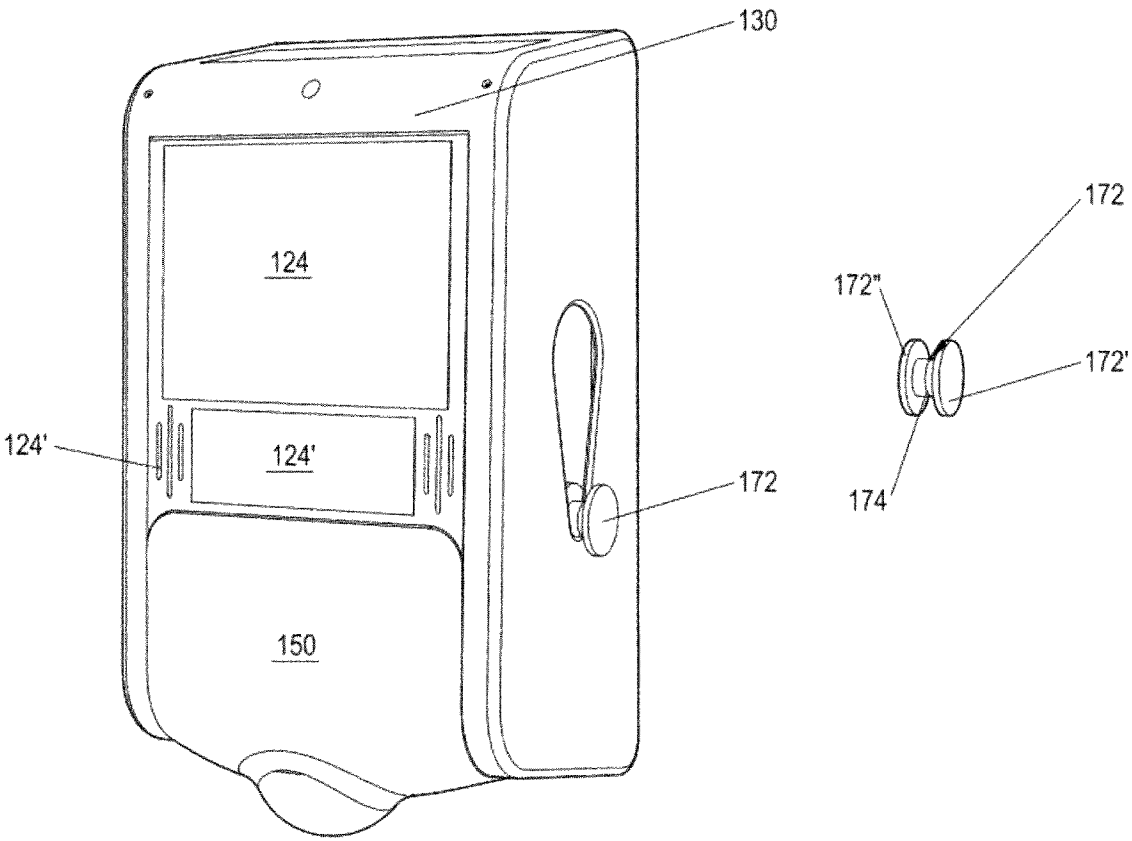
FIG. 13 is an isometric view of the of the apparatus of FIG. 8 showing the connector inserted in the housing used for connecting multiple units together.
Figure 14:
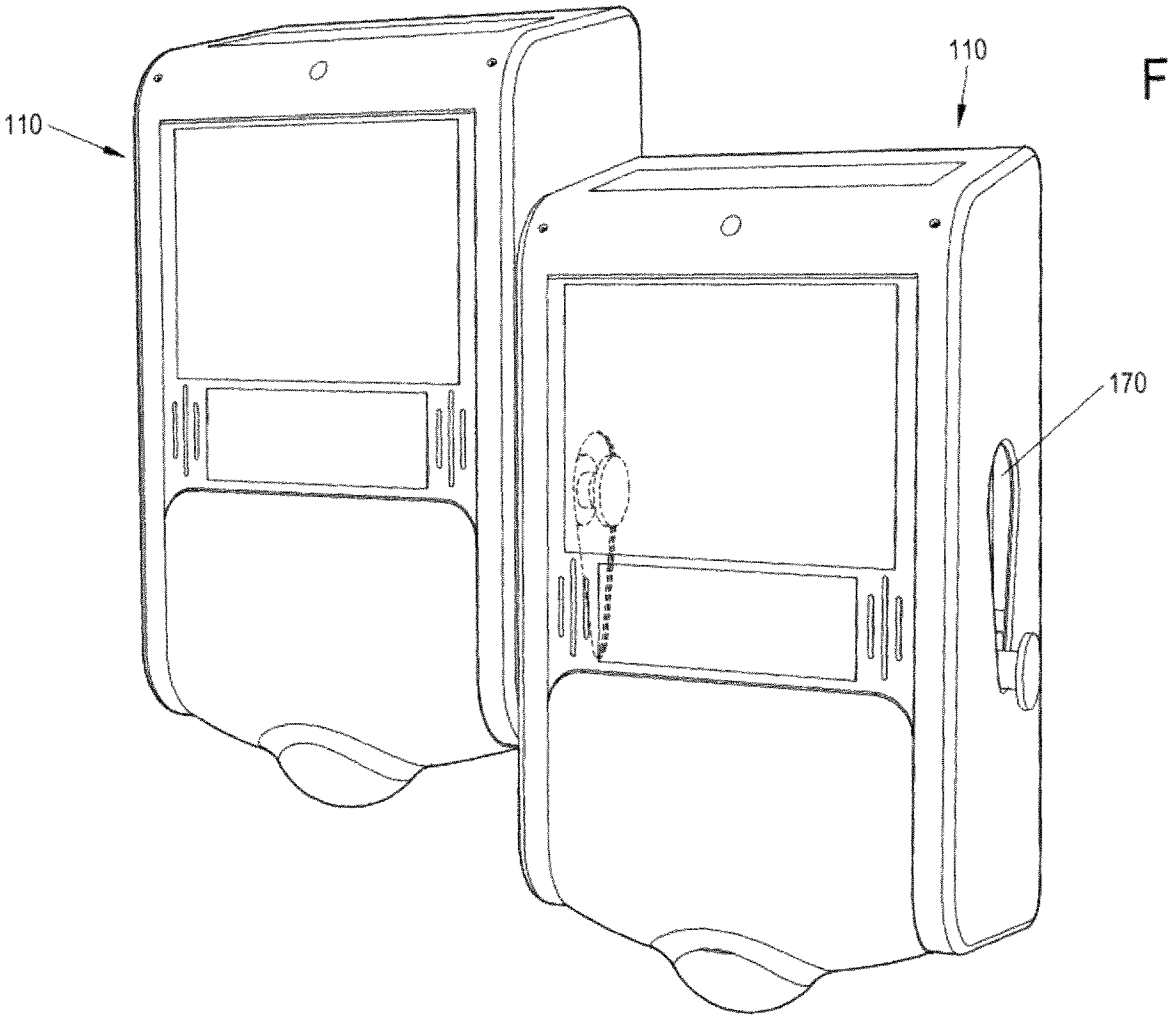
FIG. 14 is an isometric view of the of the apparatus of FIG. 8 showing the intermediate stage of the connection of two units together.
Figure 15:
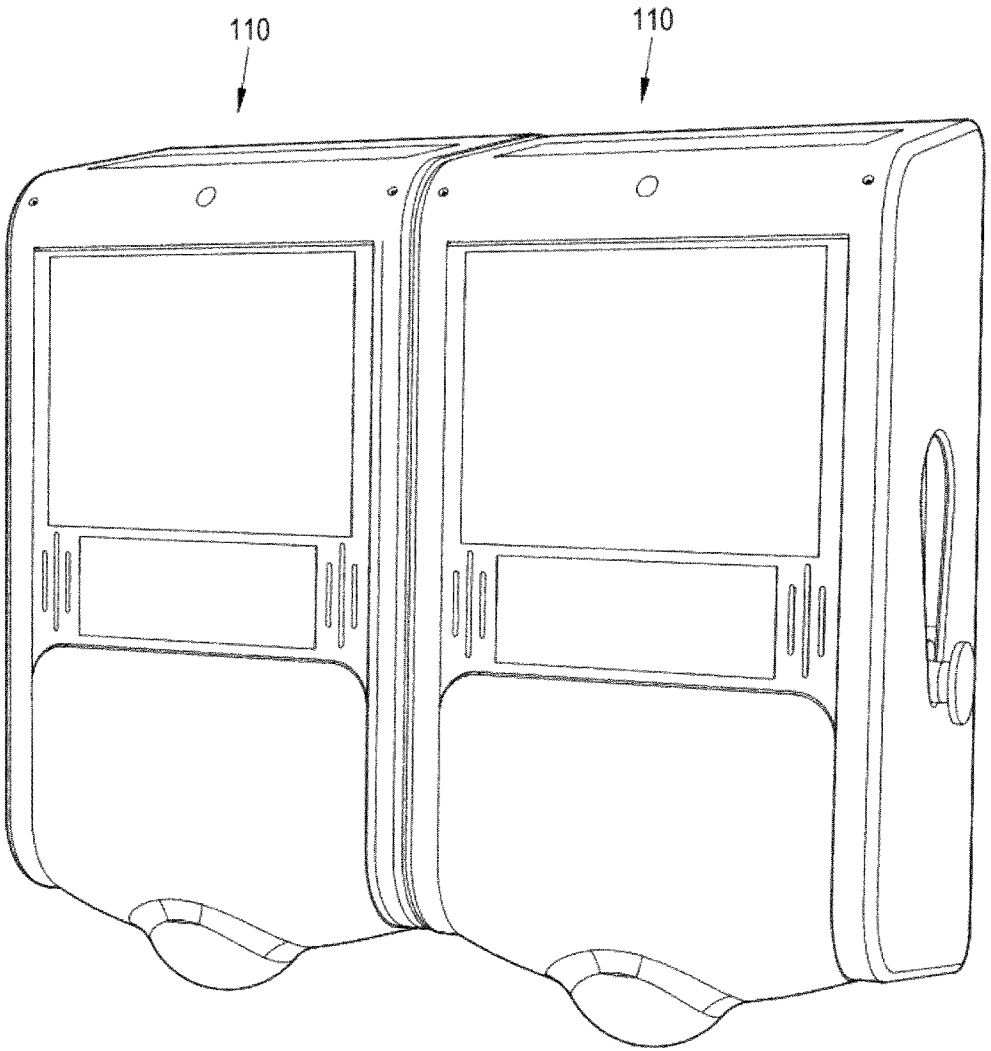
FIG. 15 is an isometric view of the of the apparatus of FIG. 8 showing the final stage of the connection of two units together.

The main housing is also provided with downwardly tapering grooves 170 formed in the side walls 114, 116. Each groove 170 is used for accepting a connecting element 172 having a pair of end-flanges 172', 172" connected via a shaft 174. The connecting element is first inserted into upper, wider gap section of a groove 170 and then slid downwardly toward the narrower lower gap section of the groove 170, such that the enlarged flanges 172', 172" sandwich therebetween the side wall 114, as best seen in FIG. 13, with the flange 172" being positioned interiorly of the side wall and the flange 172' being positioned exteriorly thereof, and such that the shaft 174 thereof frictionally retains the connecting element 172 in place at the bottom of the groove 170. Then, the exteriorly located flange 172' is inserted into the upper, wider gap section of another groove 170 of a second main housing of another dispensing apparatus 110, and then that second unit is slid upwardly until the two units are nestled side-by-side, as shown in FIGS. 14 and 15. This arrangement allows may such units to be provided at a site, and with only one of the units needing to be actually fastened to a wall.

Figure 16:
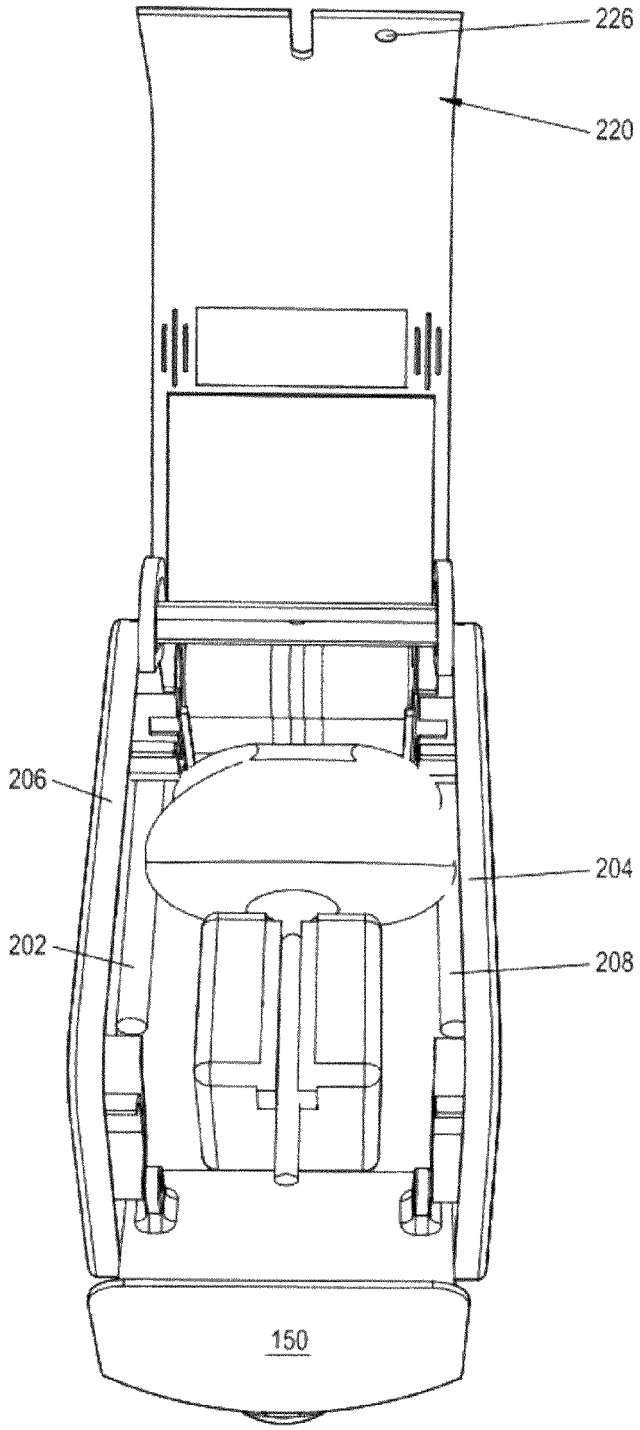
FIG. 16 is an isometric view of the dispensing apparatus of the invention in which an aerosol container is placed in the interior thereof and which is activated by a sensor to spray ambient sanitizing or disinfecting mist into the surroundings.

Referring to FIG. 16, there is shown a modification for use in either of the first and second embodiments. In this modification, the dispensing apparatus is provided with one or more pressurized, aerosol-spray canisters or containers 200, 202, or misters, which are mounted interiorly in the main housing adjacent to the upper, interior surfaces of the side walls 204, 206. Each canisters is of an approximate size of a AA battery, and rests in a track or compartment. In order to dispense a mist from the canister, the can is attached at its rear to a rod of a conventional solenoid 210. The above-mentioned sensor 158 is also used for activating this mister, which mister sprays a mist into the air after a five-second delay. This delay is the amount of time that the dispensing nozzle is activated, so that after each time the nozzle dispenses liquid, immediately thereafter the mister is activated to spray the air to sanitize it. Alternatively, a separate sensor may be used and is activated by someone entering the room, for example, which will activate the solenoid switch 210 to extend its rod to push the canister forwardly, by which the spray nozzle thereof is forced against interior surface of the front panel 220 to this depress the nozzle and cause the nozzle to spray a fine mist. The front panel is provided with an opening 226 located in close juxtaposition to and in alignment with the spray nozzle of the canister, through which hole the sprayed mist exits into the room for providing a sanitizing and pleasant mist to the ambient surroundings.

Figure 17:
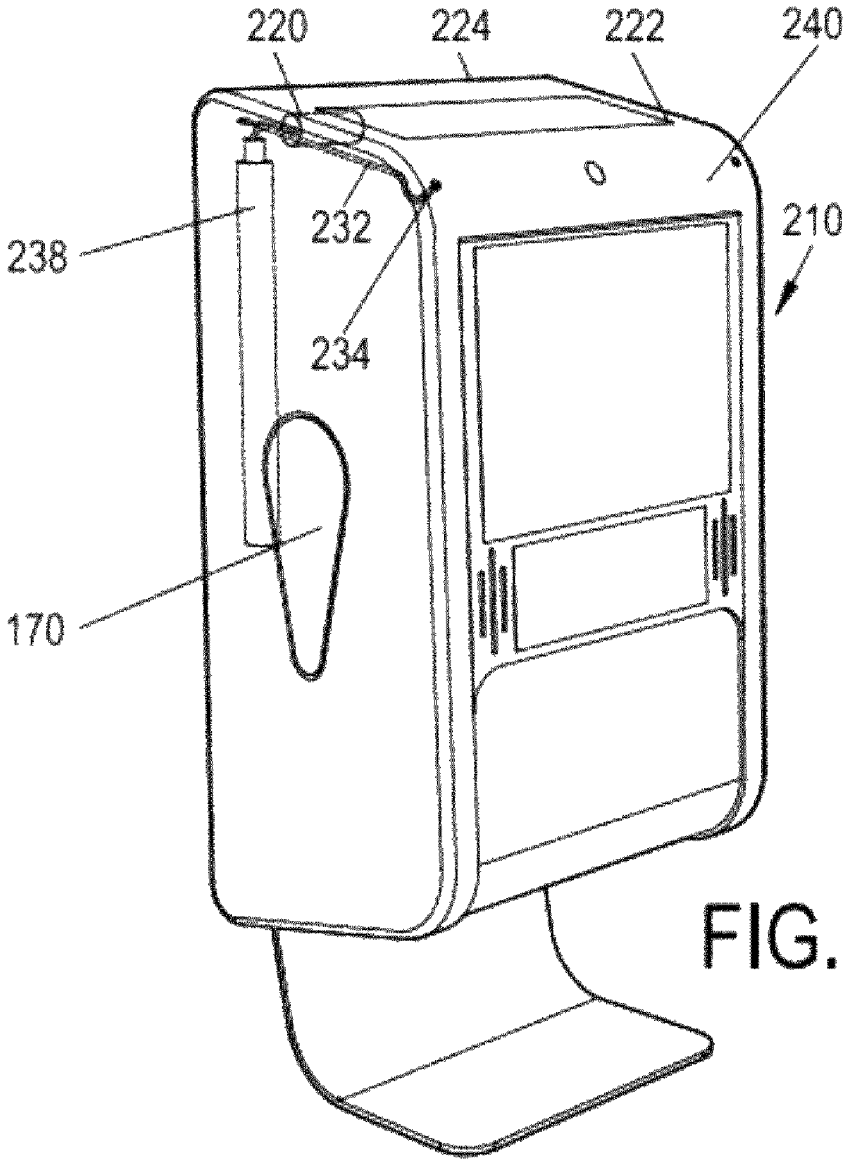
FIG. 17 is an isometric view of the dispensing apparatus showing a modification where the spray canister is located in an upper location.

Referring to FIG. 17, there is shown a modification 210 where the pressurized sanitizing spray canister 220 is mounted to bottom of the top surface 224 of the main housing 222. In this modification, the pressurized canister 220 of sanitizing spray emits a mist or spray after a valve is activated by the solenoid 230, causing the spray to exit out extension tube 232 and out through exit-opening 234 formed in the front surface of the front cover 240.

While specific embodiments of the invention have been shown and described, it is to be understood that numerous changes and modifications may be made therein without departing from the scope and spirit of the invention as set forth in the appended claims.

What is claimed is:

1. In a dispensing apparatus for dispensing fluid, such as hand-sanitary liquid, hand-antiseptic lotion, and the like, which dispensing apparatus comprises a main housing having a pair of side walls, a rear wall, a pivotal front cover pivotal to an open position to allow access to the interior of the main frame, said main housing mounting in the interior thereof an automatic dispensing station having a pump assembly and a bottom dispensing nozzle for dispensing measured amounts of fluid, a rechargeable battery-pack assembly, and a flexible, dispensing fluid-storage bag operatively connected to said pump assembly and said nozzle, and at least one solar panel operatively connected to said battery-pack assembly, the contents of said bag being dispensed through said nozzle, the improvement comprising:

a lower, pivotal tray comprising a first generally vertical section, and a second generally horizontal section, said second section having a substantially depressed upper surface for collecting unused and spilled dispensed fluid; said first vertical section having a pair of mounting elements projecting therefrom;

each of said first and second side walls of said main housing having a lower portion having a groove formed therein for receiving a respective said mounting element, each said groove having a front entrance-opening by which a respective said mounting element is received, a generally elongated straight section extending rearwardly from said entrance opening, and a rear downwardly-extending section extending from the rear of said generally elongated straight section;

said tray further comprising a rearwardly-extending protuberance for contact against a wall to which is mounted said rear wall of said main housing for orienting said tray in a pivoted state such that the forward edge surface of said second generally horizontal section of said tray is positioned forwardly of said dispensing nozzle so that the tray captures excess fluid dispensed by said nozzle.

2. The improvement according to claim 1, wherein each of said pair of side walls of said main frame comprises an intermediate cutout section between said upper portion and lower portion, in order to allow easier access to the interior of said main housing.

3. The improvement according to claim 1, wherein said pivotal front cover comprises a front surface and a pair of side surfaces, each said side surface having an upper section and an interiorly-projecting pivot pin for pivotally mounting said front cover to said upper portions of said side walls of said main housing; said pivot pins being mounted to forward portions of said side walls; said upper portions of said side walls having holes located in forward portions thereof for mounting said pivot pins, whereby when said front cover is pivoted upwardly to its open position, it remains in its upward position.

4. The improvement according to claim 1, wherein said pivotal tray further comprises an intermediate curved section connecting said first and second sections together.

5. The improvement according to claim 1, wherein said pair of mounting elements comprises a pair of spaced-apart bracket elements projecting forwardly from an upper surface area thereof and a pair of pivot pins protruding outwardly from said pair of bracket elements.

6. The improvement according to claim 1, wherein said battery-pack assembly comprises a frame, and at least one rechargeable battery mounted by said frame, said frame comprising a pair of side plates, each said side plate having a rear end and front end, and a pivot post extending from a respective said rear end;

each of said pair of said side walls of said main housing comprising an upper portion having a pivot hole formed therein, each said pivot hole pivotally mounting a respective said pivot post, whereby said frame of said battery-pack assembly is pivotally mounted in the upper interior of the said main housing;

said flexible, dispensing fluid-storage bag being removably mounted in the interior of said main housing below said battery-pack assembly, and defining an upper bag-portion surface upon which rests said battery-pack assembly, said battery-pack assembly being continually pivoted downwardly by gravity as the contents of said flexible fluid-storage bag are dispensed over time, the weight of said battery-pack assembly compressing the thus-depleted storage bag in order to maintain fluid pressure therein, whereby the time delay of the dispensing of the fluid does not increase over continued use.

7. The improvement according to claim 1, wherein said apparatus further comprises a sensor for detecting the upward positioning of said front cover and said pivotal tray, and a shut-off device for disabling said pump assembly when said sensor is activated.

8. The improvement according to claim 1, wherein said apparatus further comprises an aerosol spray assembly in said housing, said aerosol spray assembly comprising a sanitizer-mist storage element for spraying a sanitizer-mist into the ambient surroundings; and a sensor for activating said aerosol spray assembly for spraying a sanitizer-mist when said sensor is activated.

9. The improvement according to claim 1, wherein said apparatus further comprises at least one connecting element for use in connecting at least two dispensers together side-by-side; at least one of said pair of side walls having a downwardly-tapering groove defining an upper, wider gap section and a lower, narrower gap section; said at least one connecting element comprising a first enlarged flange, a second enlarged flange, and a shaft connecting said flanges together in spaced-apart relationship; said first flange being located interiorly at said lower, narrower gap section, and said second flange being located exteriorly at said lower, narrower gap section when said at least one connecting element is mounted therein, with said shaft frictionally retaining said at least one connecting element in place at the bottom of said groove, whereby when said second flange is inserted into another said groove of another dispensing apparatus and moved upwardly, said shaft of said at least one connecting element also frictionally retains said at least one connecting element in place at the bottom said another groove.

10. In a dispensing apparatus for dispensing fluid, such as hand sanitary liquid, hand antiseptic lotion, and the like, which dispensing apparatus comprises a main housing having a pair of side walls, a rear wall, a pivotal front cover pivotal to an open position to allow access to the interior of the main frame, said main housing mounting in the interior thereof an automatic dispensing station having a pump assembly and a bottom dispensing nozzle for dispensing measured amounts of fluid, a rechargeable battery-pack assembly, and a flexible, dispensing fluid-storage bag operatively connected to said pump assembly and said nozzle, and at least one solar panel operatively connected to said battery-pack assembly, the contents of said bag being dispensed through said nozzle, the improvement comprising:

said battery-pack assembly comprising a frame, and at least one rechargeable battery mounted by said frame, said frame comprising a pair of side plates, each said side plate having a rear end and front end, and a first pivot element extending from a respective said rear end;

each of said pair of said side walls of said main housing comprising an upper portion having a second pivot element, each said second pivot element pivotally mounting a respective said first pivot element, whereby said frame of said battery-pack assembly is pivotally mounted in the upper interior of the said main housing;

said flexible, dispensing fluid-storage bag being removably mounted in the interior of said main housing below said battery-pack assembly, and defining an upper bag-portion surface upon which rests said battery-pack assembly, said battery-pack assembly being continually pivoted downwardly by gravity as the contents of said flexible fluid-storage bag are dispensed over time, the weight of said battery-pack assembly compressing the thus-depleted storage bag in order to maintain fluid pressure therein, whereby the time delay of the dispensing of the fluid does not increase over continued use.

11. The improvement according to claim 10, wherein said pivotal front cover comprises a front surface and a pair of side surfaces, each said side surface having an upper section and an interiorly-projecting pivot pin for pivotally mounting said front cover to said upper portions of said side walls of said main housing; said pivot pins being mounted to forward portions of said side walls; said upper portions of said side walls having holes located in forward portions thereof for mounting said pivot pins, whereby when said front cover is pivoted upwardly to its open position, it remains in its upward position.

12. The improvement according to claim 10, further comprising a lower, pivotal tray comprising a first generally vertical section, and a generally horizontal section, said second section having a substantially depressed upper surface for collecting unused and spilled dispensed fluid; said first vertical section having a pair of mounting elements projecting therefrom;

each of said first and second side walls of said main housing having a lower portion having a groove formed therein for receiving a respective said mounting element, each said groove having a front entrance-opening by which a respective said mounting element is received, a generally elongated straight section extending rearwardly from said entrance opening, and a rear downwardly-extending section extending from the rear of said generally elongated straight section;

said tray further comprising a rearwardly-extending protuberance for contact against a wall to which is mounted said rear wall of said main housing for orienting said tray in a pivoted state such that the forward edge surface of said second generally horizontal section of said tray is positioned forwardly of said dispensing nozzle so that the tray captures excess fluid dispensed by said nozzle.

13. The improvement according to claim 11, wherein said pivotal tray further comprises an intermediate curved section connecting said first and second sections together.

14. The improvement according to claim 11, wherein said pair of mounting elements comprises a pair of spaced-apart bracket elements projecting forwardly from an upper surface area of thereof and a pair of pivot pins protruding outwardly from said pair of bracket elements.

15. The improvement according to claim 10, wherein said apparatus further comprises an aerosol spray assembly in said housing, said aerosol spray assembly comprising a sanitizer-mist storage element for spraying a sanitizer-mist into the ambient surroundings; and a sensor for activating said aerosol spray assembly for spraying a sanitizer-mist.

16. In a dispensing apparatus for dispensing fluid, such as hand sanitary liquid, hand antiseptic lotion, and the like, which dispensing apparatus comprises a main housing having a pair of side walls, a rear wall, a pivotal front cover pivotal to an open position to allow access to the interior of the main frame, said main housing mounting in the interior thereof an automatic dispensing station having a pump assembly and a dispensing nozzle for dispensing measured amounts of fluid, a rechargeable battery-pack assembly, and a flexible, dispensing fluid-storage bag operatively connected to said pump assembly and said nozzle, the contents of said bag being dispensed through said nozzle, a method of minimizing the time-delay of dispensing the fluid comprising:

(a) pivotally mounting said battery-pack assembly in the interior of said main housing for pivotal motion in a vertical direction;

(b) providing a removable, flexible, dispensing fluid-storage bag in the interior of said main housing directly below and in close proximity to said battery-pack assembly;

(c) initially resting said battery-pack assembly on an upper surface portion of a newly-provided fluid-storage bag;

(d) inherently intermittently pivoting said battery-pack assembly downwardly as the contents of said flexible fluid-storage bag are dispensed over time;

(e) said step (d) comprising having said battery-pack assembly intermittently pivot downwardly via gravity and compressing the thus-depleted storage bag in order to maintain fluid pressure therein, whereby the time delay of the dispensing of the fluid does not increase over continued use.

17. The method according to claim 16, further comprising:

(f) manually pivoting said battery-pack assembly upwardly away from said storage bag;

(g) removing said storage bag from the interior of said main housing;

(h) replacing said removed storage bag of said step (g) with a new, full storage bag; and (i) repeating said step (c).

18. The method according to claim 16, further comprising:

(f) mounting a lower, pivotal tray comprising a first generally vertical section and a second generally horizontal section below said dispensing nozzle in order to collect excess fluid exiting from the nozzle and hands;

(g) said step (f) providing a rearwardly-projecting element from said pivotal tray for contact against a vertical wall to which the dispensing apparatus is mounted;

(h) said step (g) positioning said tray in a forwardly-pivoted state such that the front edge surface of said generally horizontal section projects considerably forwardly beyond said dispensing nozzle.

19. The method according to claim 16, further comprising:

(i) disabling said pump assembly when at least one of said pivotal tray and said front cover is pivoted upwardly to a raised position.

20. The method according to claim 16, further comprising:

(i) mounting an aerosol spray assembly in said housing, said aerosol spray assembly comprising a sanitizer-mist storage element for spraying a sanitizer-mist into the ambient surroundings;

(j) activating, via a sensor, said aerosol spray assembly; and (k) spraying a sanitizer-mist when said sensor is activated into the ambient surroundings.

* * * * *